United States Patent [19]

Broomfield

[11] 4,023,740

[45] * May 17, 1977

[54] BOBBIN TERMINATOR

[75] Inventor: John Broomfield, Bolton, Mass.

[73] Assignee: Amacoil Machinery, Inc., New Rochelle, N.Y.

[ * ] Notice: The portion of the term of this patent subsequent to Apr. 13, 1993, has been disclaimed.

[22] Filed: Apr. 23, 1975

[21] Appl. No.: 570,575

Related U.S. Application Data

[63] Continuation-in-part of Ser. No. 493,776, Aug. 1, 1974, Pat. No. 3,949,945, which is a continuation-in-part of Ser. No. 224,686, Feb. 9, 1972, abandoned.

[52] U.S. Cl. ..... 242/7.17; 242/7.03; 242/7.14

[51] Int. Cl.[2] ..... H01F 41/06; H01F 41/10

[58] Field of Search ..... 242/7.17, 7.06, 7.03, 242/7.14; 140/92.2, 124, 119; 29/203 B, 605, 33 M

[56] References Cited

UNITED STATES PATENTS

| | | | |
|---|---|---|---|
| 2,963,051 | 12/1960 | Shaw et al. | 242/7.18 |
| 3,019,822 | 2/1962 | Jacobson | 242/7.17 |
| 3,759,454 | 9/1973 | Bernard | 242/7.06 |
| 3,949,945 | 4/1976 | Broomfield | 242/7.03 |

*Primary Examiner*—George F. Mautz
*Attorney, Agent, or Firm*—Bierman & Bierman

[57] ABSTRACT

Apparatus for wrapping wire on the terminals of a bobbin employs a notched gear for engaging the wire. The rotation of the notched gear having the wire passing through the notch wraps the wire around the bobbin terminal and breaks the wire after wrapping has been completed.

25 Claims, 25 Drawing Figures

BOBBIN TERMINATOR

This is a continuation-in-part of co-pending application Ser. No. 493,776, filed Aug. 1, 1974, now U.S. Pat. No. 3,949,945 which is a continuation-in-part of application Ser. No. 224,686, filed Feb. 9, 1972, now abandoned.

This invention relates to apparatus for winding wire and more particularly to an apparatus for wrapping wire on the terminals of a wire carrying bobbin.

In accordance with the present invention, apparatus is provided for engaging a wire extending from a bobbin and for wrapping the wire tightly on the terminal.

In the present automatic bobbin winding system, the wire extending from the bobbin is held under tension for easy handling by the winding apparatus. After the wire has been wrapped around the terminal a desired number of times, the apparatus may be pivoted to break the wire neatly at the edge of the terminal.

The apparatus of the instant invention comprises a housing having a wire carrying means therein for engaging a wire extending from the bobbin. The wire carrying means has means for rotating the wire on the terminal of the bobbin associated therewith.

In its preferred form, the apparatus wire carrying means in part comprises a housing having a flared guide into which a first gear having a notch extends. The notch is normally aligned with the guide so that the wire passes through the guide and into the notch. In addition, a hollow cylindrical protrusion with a lateral groove is provided adjacent to the guide. The groove is in alignment with the notch so that the wire is also held within the protrusion.

The apparatus is positioned so that the protrusion will rotate around the terminal, thus wrapping the wire thereon. Rotation may be achieved by means of a motor connected to a second gear whose teeth mesh with the teeth of the first gear. At the end of the rotation cycle, the apparatus is pivoted and the wire is broken.

The apparatus of the instant invention is particularly useful in connection with automatic bobbin core winding apparatus. The apparatus, or terminator as it will be referred to from time to time herein, is mounted facing the bobbin, which bobbin is generally held on a rotatable shaft. The terminator is kept spaced from the bobbin while wire is being wrapped around the bobbin. After the wire is wrapped around the bobbin, the terminator is moved towards the bobbin and the flared guide positioned adjacent one of the terminals of the bobbin. The wire is grasped by the flared guide and wrapped around the terminal a selected number of times. Means are provided in connection with the terminator for breaking the wire, preferably very close to the terminal. After the wire is broken, the terminator is moved away from the bobbin.

Bobbins may have terminals placed at any point on the periphery of the bobbin. To accomodate these differently placed terminals, the terminator is preferably mounted on a frame with respect to which the terminator can move in both a vertical and horizontal direction to permit repositioning of the terminator in order to wrap wire about a terminal regardless of its position on the periphery of the bobbin.

Further, the wire to be wrapped around the bobbin terminal may exit from the bobbin at a position which is not directly in line with the terminal. For situations such as this, means are provided for pivoting the terminator into a position to permit the terminator to pick up the wire in the flared guide and to return the terminator to a position in which it can wrap the wire about the terminal.

Of course, a plurality of terminators may be used for wrapping wire about several terminals concurrently.

Now turning to the drawings in which several preferred embodiments of the present invention are depicted and wherein like numerals refer to like parts:

Figure 13:
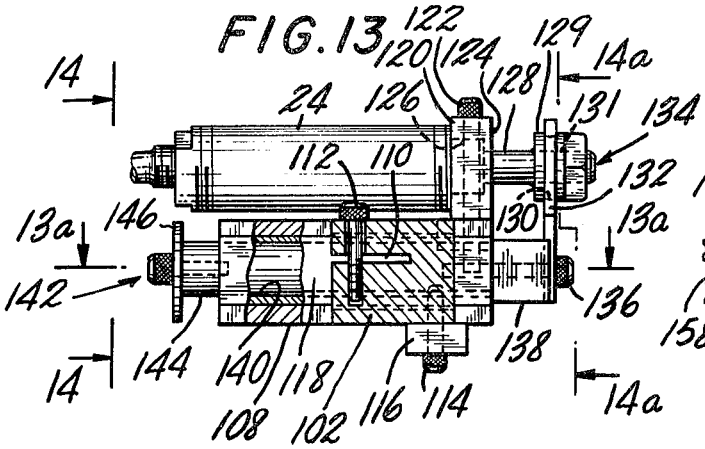
FIG. 13 is a detail view of the male section of an assembly used for mounting the terminator head.

FIG. **13*a* is a front view of the assembly shown in FIG. 13 taken along line 13*a*—13*a***.

Figure 14:
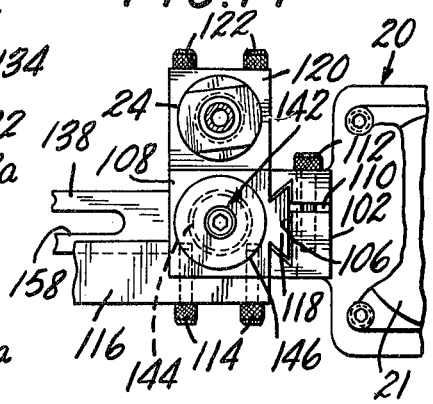
Figure 13A:
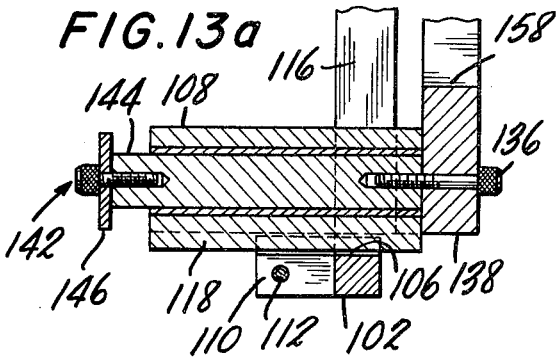

FIG. 14 is a detail view of the female member of the assembly shown in FIG. 13.

FIG. **14*a* is a front view of the female member shown in FIG. 14 taken along line 14*a*—14*a***.

Figure 15:
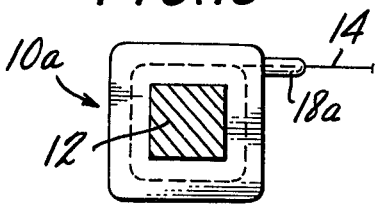

FIG. 15 is a front view of a bobbin having a terminal adjacent the top thereof.

Figure 16:
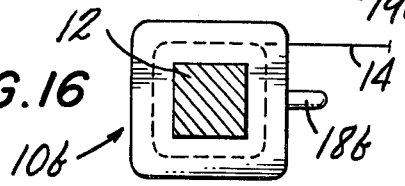

FIG. 16 is a front view of a bobbin similar to 15 and having a terminal displaced downwardly towards the middle thereof.

Figure 10:
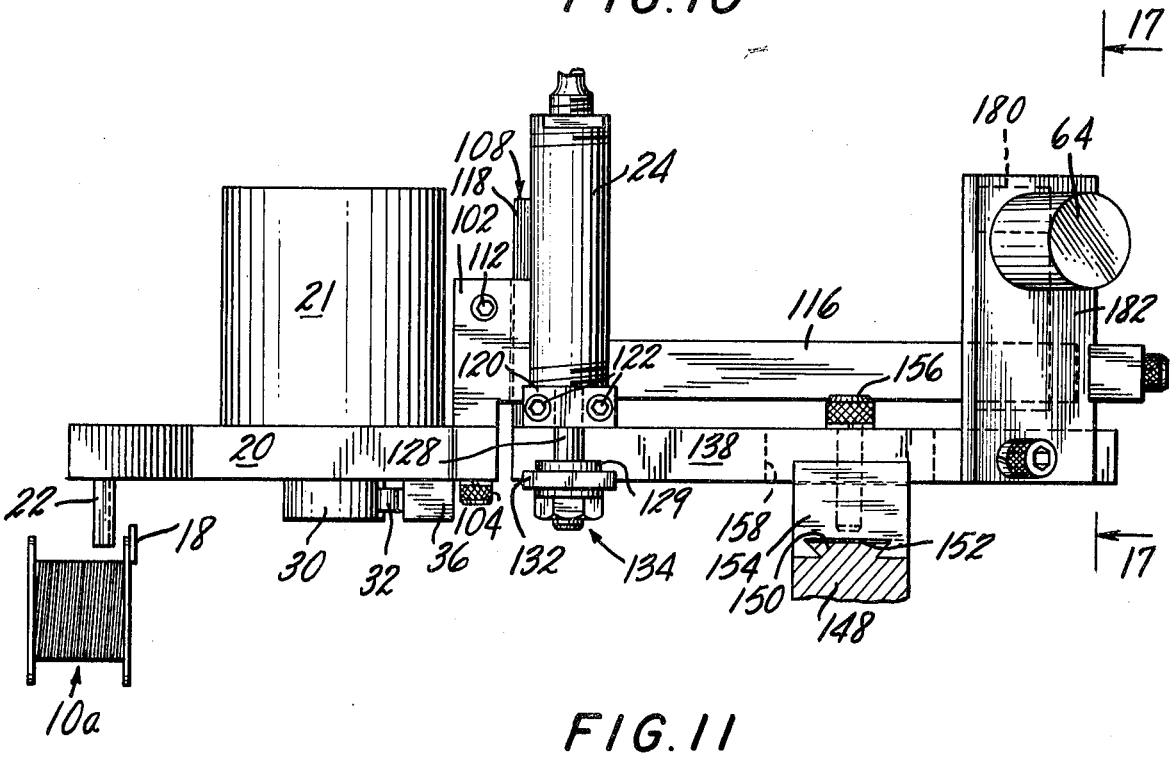
FIG. 10 is a top view of the terminator of FIG. 8 and showing the terminator in a translated position.
Figure 17:
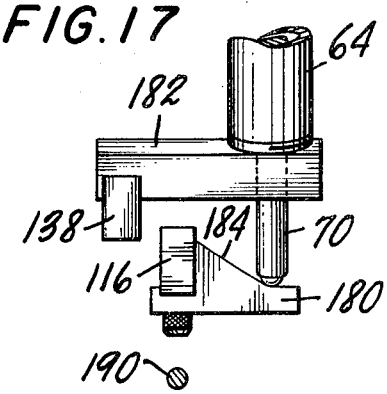

FIG. 17 is a detailed rear view of the terminator of FIG. 10 taken along line 17—17 in FIG. 10.

Figure 11:
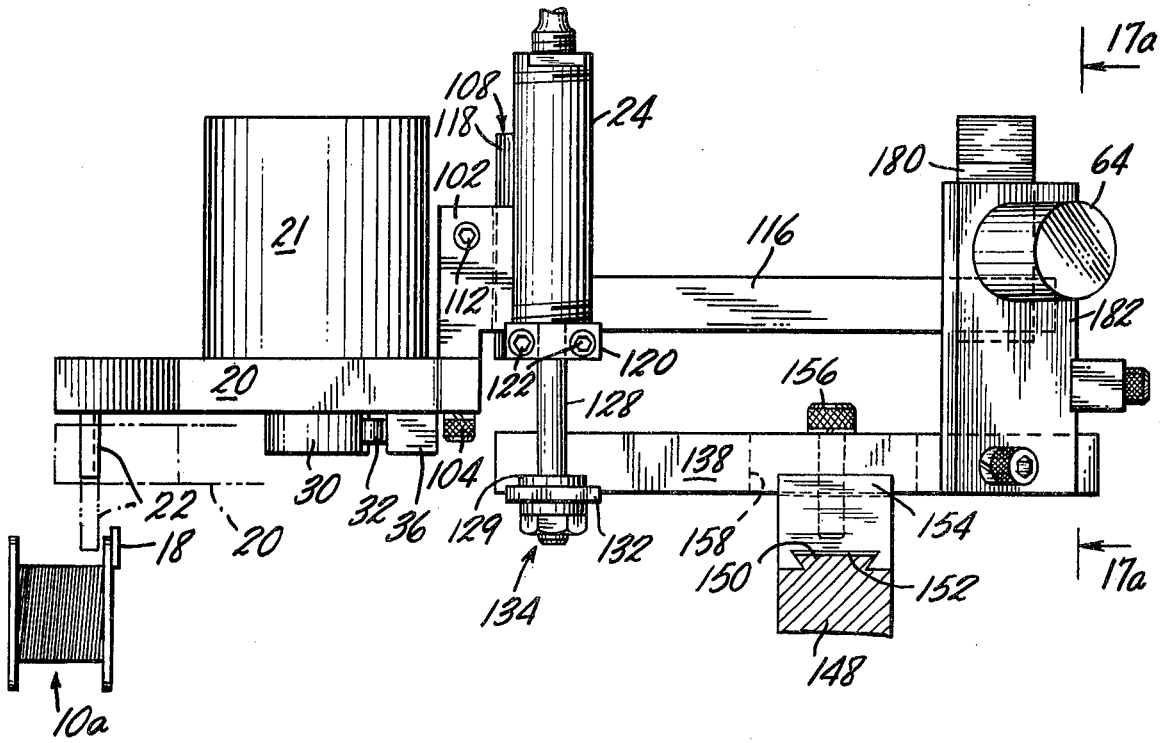
FIG. 11 is a top view of the terminator of FIG. 8 showing the terminator in position away from a bobbin terminal.

FIG. **17*a* is a rear view of the terminator of FIG. 11 taken along line 17*a*—17*a* in FIG. 11.**

Figure 8:
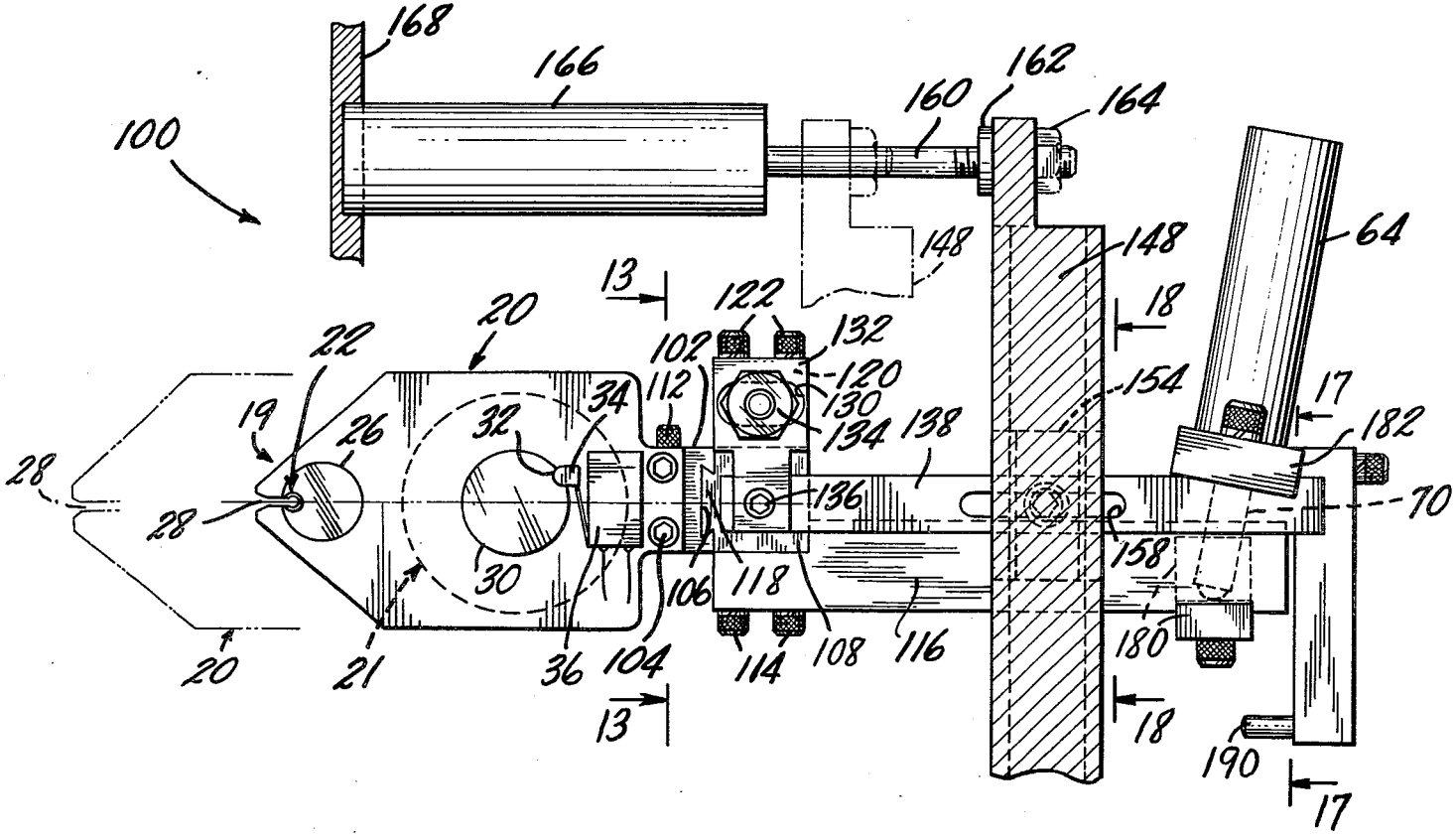
FIG. 8 is a side view of another terminator assembly.
Figure 19:
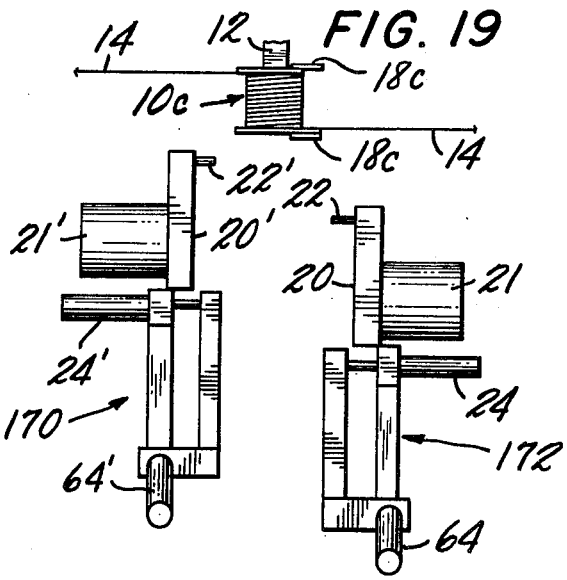
Figure 20:
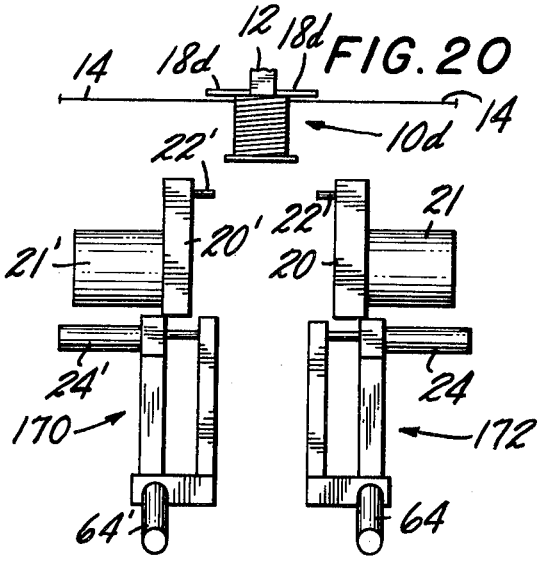
Figure 21:
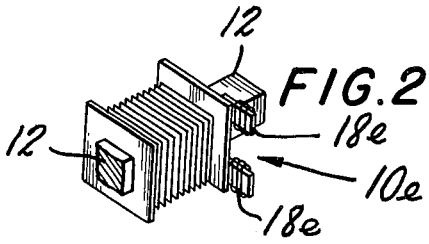
Figure 18:
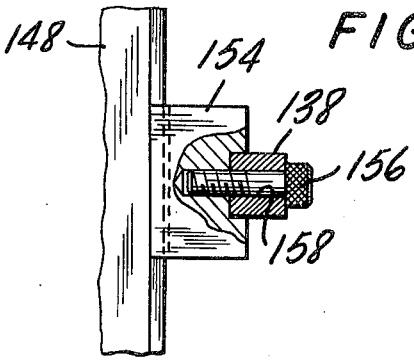
Figure 22:
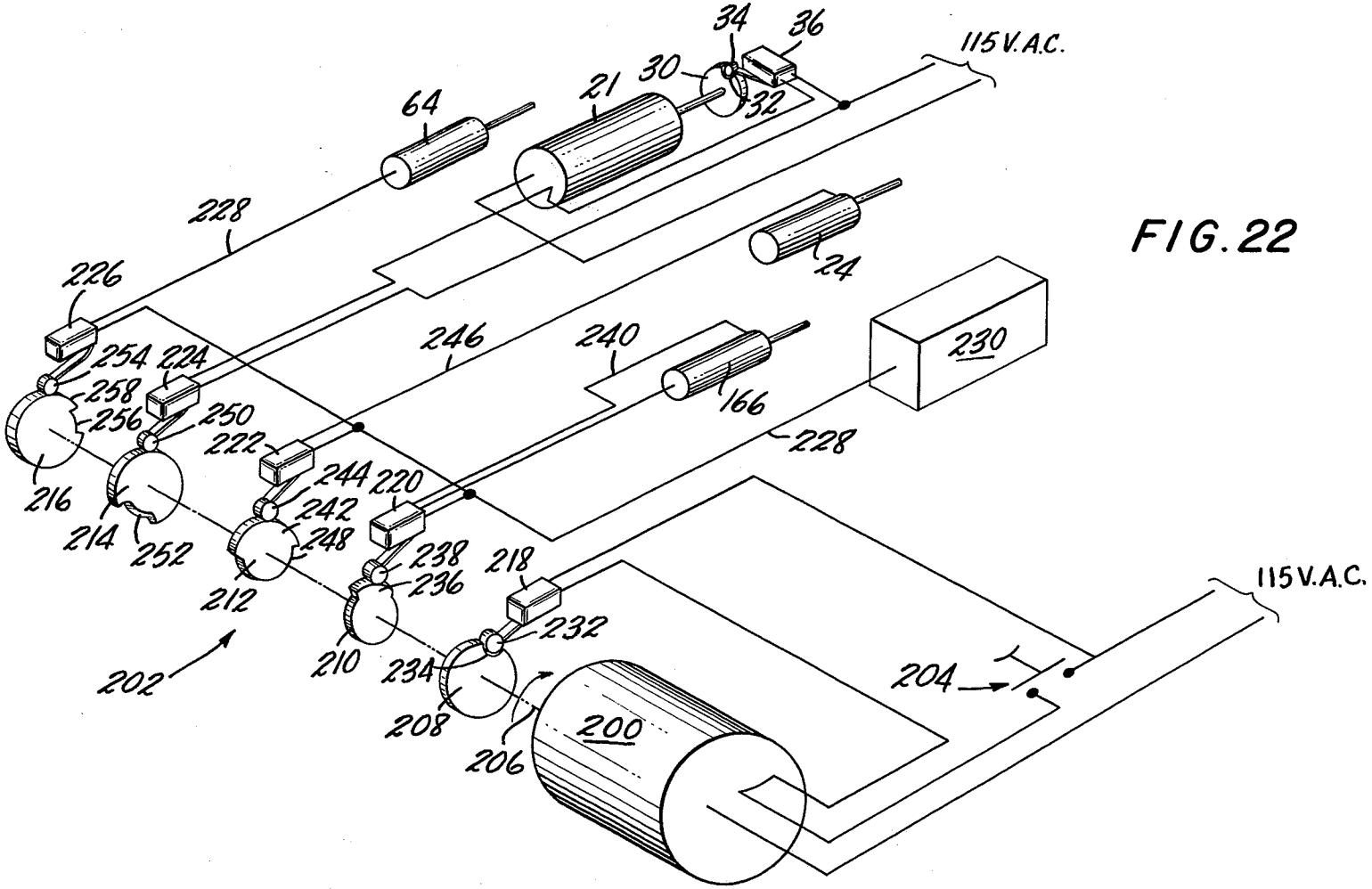

FIG. 18 is a detail view of the support rail shown in FIG. 8 taken along line 18—18 in FIG. 8;

FIG. 19 is a schematic top view of an automatic terminating apparatus for wrapping wire about two bobbin terminals;

FIG. 20 is a schematic top view of an automatic terminating apparatus also for wrapping wire about two bobbin terminators;

FIG. 21 is an isometric view of still another type of bobbin;

FIG. 22 shows an apparatus in schematic form for controlling the sequence of operations of the terminator.

Figure 1:
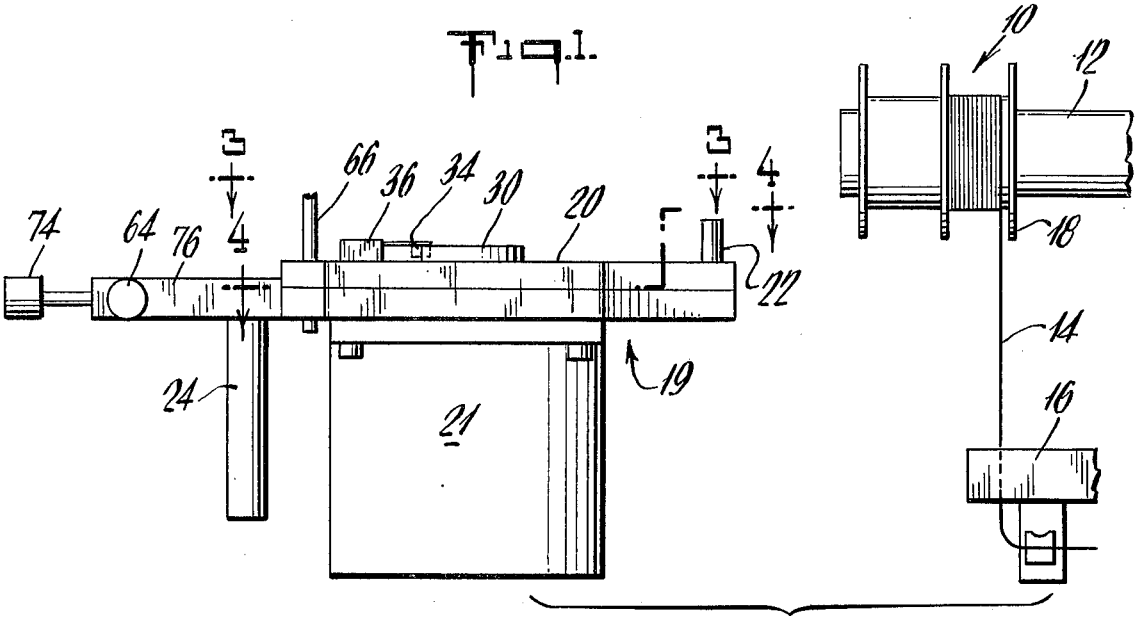
FIG. 1 is a top elevated view of the apparatus before engaging the wire.

The apparatus 19 for wrapping wire on the terminals of the bobbin is normally set up for automatic operation, and has a casing 21 containing a motor and a housing 20 enclosing a plurality of gears 26 and 38. As is readily appreciated from FIG. 1, the apparatus is initially out of contact with the wire 14. In this initial position, bobbin 10 is held securely by a bobbin holder 12, wire 14 has already been wound around and is extending from bobbin 10 in a position generally parallel to terminal 18. The wire 14 is held under tension by feeding means 16.

Figure 3:
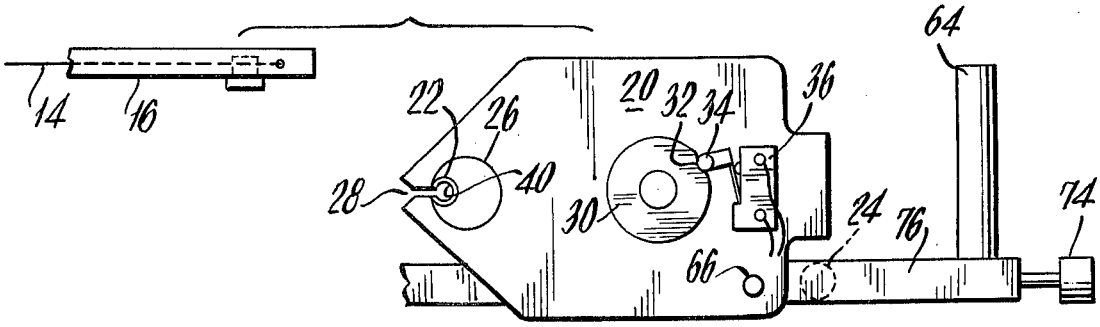
FIG. 3 is an approximately full scale view of the housing, taken along line 3–3 of FIG. 1.

FIG. 3 shows a side view of the housing 20 along lines 3—3. Gear 26 is rotatably mounted in housing 20. Gear 26 has a notch 40 aligned with guide 28 provided on the forward section of housing 20. A protrusion 22 is mounted on gear 26. The protrusion 22 has a lateral groove which is also aligned with guide 28 to permit wire 14 to pass into notch 40 and protrusion 22 for engagement by housing 20 when the housing is moved into operating position.

Figure 4:
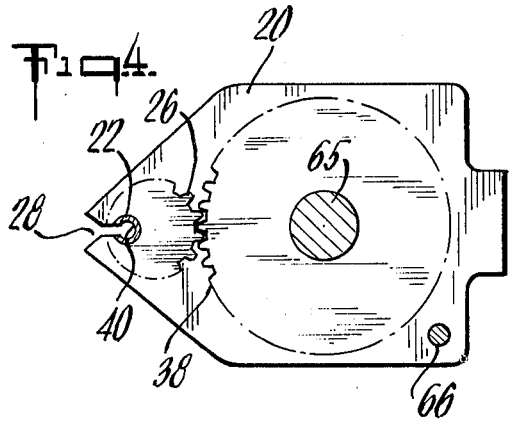
FIG. 4 is an approximately full scale view of the housing of FIG. 1 taken along line 4—4 of FIG. 1.
Figure 5:
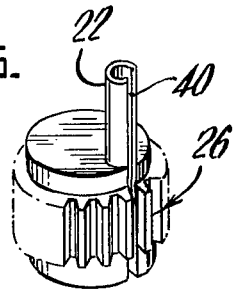
FIG. 5 is an enlarged detail view of one of the gears in the housing.

FIG. 4 shows the inside of housing 20. As shown, the teeth of gear 26 are meshed with the teeth of a gear 38. Gear 38 is fixedly mounted to shaft 65 of a motor (not shown) located on the opposite side of housing 20 directly behind gear 38 as seen in FIG. 4.

A cam 30, shown in FIG. 3, is mounted on the gear 38, cam 30 extends to the outside of housing 20 and has a recess 32 on its extended portion. A cam follower 34 is provided in contact with the circumference of cam 30 and initially with recess 32. The base of cam follower 34 is connected to a single pole double throw microswitch 36 which is also mounted on the side of housing 20.

Figure 2:
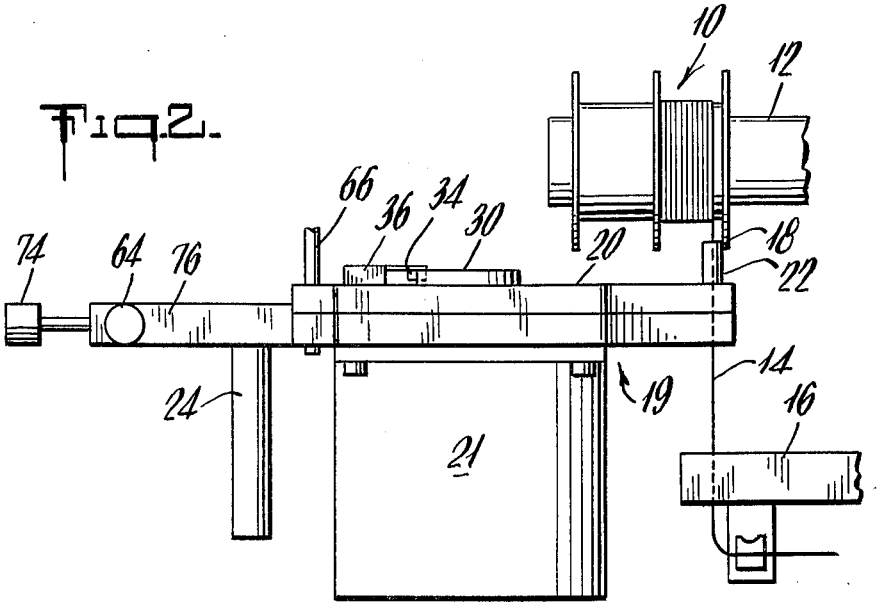
FIG. 2 shows the apparatus of FIG. 1 in operational position.

FIG. 2 shows housing 20 at the start of a wrapping cycle. The housing 20, lever 76, air cylinders 24 and 64 shown in the drawings are mounted for inward translation on a movable section of the frame of the apparatus (not shown). Extension of the piston of air cylinder 74 moves the housing 20 from the position shown in FIG. 1 to the position shown in FIG. 2 in which the wire 14 has passed through groove 28 and is contained within notch 40 and protrusion 22. The outer end of protrusion 22 is now located adjacent to the base of terminal 18 but slightly off to the side. The motor is automatically activated upon the translation of apparatus 19 into operating position and gear 38, connected to the shaft 65 of the motor, begins to rotate. The rotation of gear 38 rotates cam 30. Gear 26, whose teeth are meshed with the teeth of gear 38 is rotated by gear 38. As the gear 26 rotates, the protrusion 22 and wire 14 contained therein are caused to revolve around terminal 18 to wrap wire 14 on the terminal.

The housing 20 can be moved in a transverse direction to permit its use with different types of bobbins 10 and to move the housing 20 closer to the bobbin. To achieve this, a conventional air cylinder 24 is provided. Cylinder 24 is connected to lever 76 and its piston is connected to the frame (not shown) so that movement of the piston will effect a repositioning of the housing 20.

For best results, gear 26 should have a gear ratio with respect to gear 38, such that for one complete revolution of the gear 38, gear 26 will rotate a number of times equal to the number of wrappings desired on the terminal, preferably at least three times. Thus the whole wrapping cycle takes place during the time gear 38 goes through one complete revolution.

Figure 7:
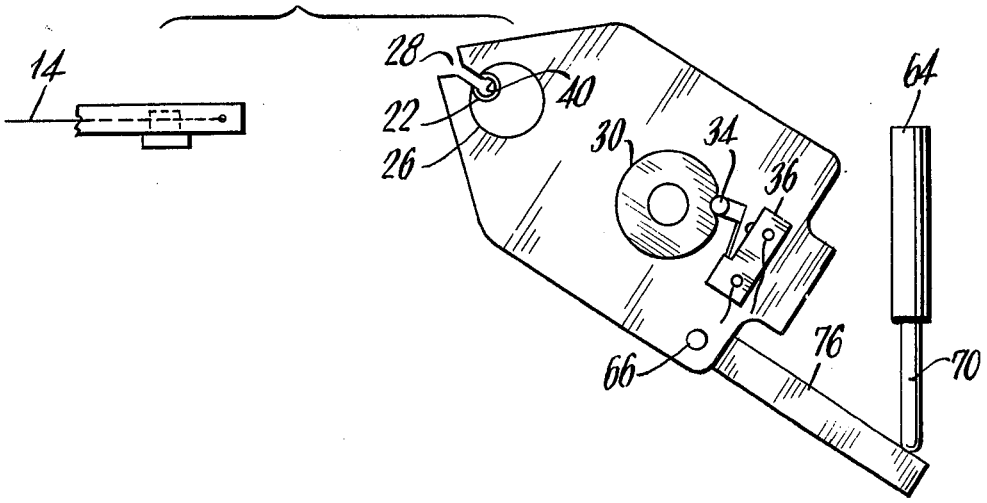
FIG. 7 depicts the apparatus of FIG. 1 pivoted to a position in which the apparatus will break the wire.

When cam follower 34 detects one full rotation of the cam 30 by sensing the return of recess 32 to its original location, switch 36 is operated to deactivate the motor and the wrapping cycle is then complete. Wire 14 at this point is fully wrapped around terminal 18 and is still held within apparatus 19. Simultaneously, with deactivation of the motor switch 36, cylinder 64 is activated to pivot apparatus 19 about a bar 66 and away from the bobbin holder 12 as shown in FIG. 7. Apparatus 19 is mounted on lever 76, and a bar or pin 66 extends through both housing 20 and lever 76 and is slidably connected to a portion of the frame (not shown). Cylinder 64 is mounted above lever 76 and has its piston 70 resting on the lever (see FIG. 7). When cylinder 64 is activated, the piston 70 extends to pivot lever 76 and housing 20 about pin 66 to the position shown in FIG. 7. This pivoting movement breaks the wire at the terminal 18 and the operation is complete.

The pivoting motion of the apparatus 19 bends the wire at the terminal. Stress concentration occurs in the bent portion of the wire, thereby assuring that the wire will break at the terminal itself.

Figure 6:
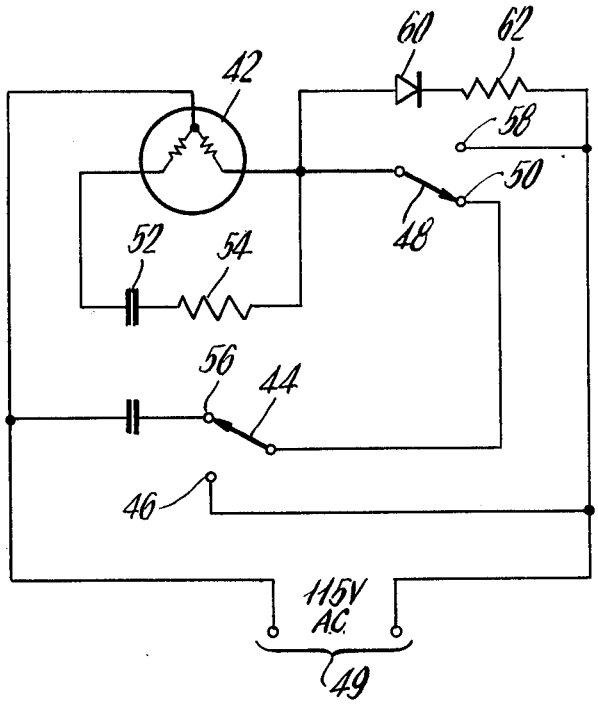
FIG. 6 is a schematic of a preferred form of circuit.

The circuitry of switch 36 is shown in FIG. 6. Switch 44 comprises a set of single pole double throw contacts of a relay (not shown) which is located in the base of the machine. The relay receives a pulse of current of short duration from a conventional drum sequence switch (not shown) upon the movement of apparatus 19 located in the base of the apparatus (not shown) into operating position to engage wire 14. Upon receiving the pulse, switch 44 removes the braking current from motor 42 thereby momentarily breaking contact with terminal 46 during which time motor 42 revolves sufficiently to bring cam follower 34 of switch 48 to the top of cam 30. During the time interval when cam follower 34 is at the top of cam 30, switch 48 is in contact with terminal 50 and motor 42 is operational. Switch 48 remains in this position for one revolution of the motor shaft and cam 30.

After one full revolution cam follower 34 again rests in the bottom of cam 30. Switch 44 is in contact with wire terminal 46 to apply braking current to the motor through switch 48. Switch 48 in this position is connected to terminal 58 by the action of cam follower 34 whereby rectifier 60 and resistor 62 complete a direct current braking circuit to stop motor 42 from turning gear 38. The cycle is then complete.

The entire cycle has a duration of less than three fourths of a second. It is therefore necessary that the pulse of current given to the coil of switch 44 be of very short duration to make sure switch 44 is in contact with terminal 46 before the completion of the revolution.

Motor 42 can be of the type SS-25 Slo-Syn motor of the type produced by Superior Electric Company. It is a stepping motor herein used as an A.C. driving motor.

In FIGS. 8–12, the terminator section 100 of an automatic bobbin winding machine is shown. The terminator comprises a housing 20 which is mounted on block 102 by conventional screws 104. Block 102 is more clearly seen in FIGS. 14, 14*a*. Block 102 is provided with a recess 106 which is in the shape of a dove tail and represents the female section of a connecting assembly.

Figure 14A:
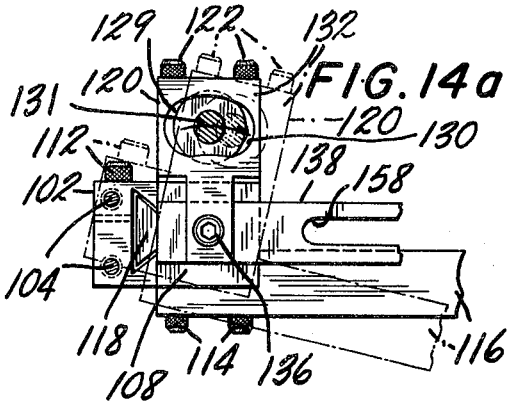

Block 102 has a slit 110 therein which extends partially along the length of the block 102. A screw 112 is mounted to pass through the slit as shown in FIG. 14*a*. When screw 112 is tightened, the sections of block 102 above and below the slit 110 will be moved together to narrow the opening 106.

A male block 108 is fixedly mounted by screws 114 to pivot arm 116. The male dove tail 118 slidably fits within recess 106. Housing 20, being mounted to female block 102, can be positioned along male protrusion 118 to adjust the alignment between the housing 20 and pivot arm or shaft 116.

Fixedly mounted atop block 108 is a connecting block 120 (FIG. 13). Conventional screws 122 extend through connecting block 120 and into block 108. Block 120 is provided with a bore 124 which opens into recess 126. Air cylinder 24 is fixedly mounted in recess 126 and its piston 128 extends through bore 124. Also mounted on piston 128 is a threaded washer 129 which is held adjacent block 132 by piston rod 128 which has a threaded end to accept washer 129.

The end of piston rod 128 is threaded to accept nut and washer assembly 134. The washer 129 and nut and washer assembly 134 engage opposite sides of block 132 to retain the piston rod in the block.

Block 132 is provided with an elongated slot 130 through which piston rod 128 extends. Block 132 is movable with respect to piston rod 128. This is achieved by not pressing washer 129 and bolt and washer assembly 134 tightly against the block 132. The reason for this movement will be explained in greater detail hereinbelow.

Block 108 is provided with a bore 140 which extends thereinthrough. A cylindrical shaft 144 is mounted in bore 140 for relative rotation of block 108. A cap assembly 142 which comprises a screw and washer 146 is positioned at the left end of shaft 144 and spaced somewhat from block 108 (FIG. 13).

Figure 17A:
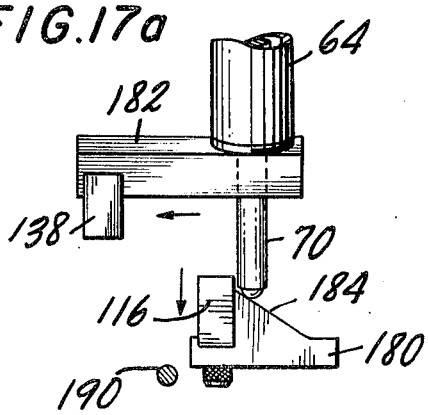

Air cylinder 24 is provided with a return spring (not shown) which normally urges piston rod 128 into the air cylinder. Upon application of pressure to extend the piston rod, lever 116, air cylinder 24, block 108 and housing 20 translate from the position shown in FIG. 13 to the position shown in FIGS. 11 and 17*a*. The amount of translatory motion permitted is governed by the length of shaft 144 which extends beyond block 108. When the block 108 contacts screw and washer assembly 146 (FIG. 13), the translatory motion is halted. When air pressure is released, i.e. when the air cylinder is deenergized, piston rod 128 is urged back into air cylinder 24, thereby returning the housing 20 and the various elements connected thereto to the position shown in FIG. 10.

FIG. 11 shows the normal position of the levers 116, 138 in which piston rod 128 is extended. In this figure, bobbin 10*a*, which is held by a bobbin winding apparatus (not shown), is positioned a selected distance away from the terminator housing 20. Guide 22 is positioned somewhat spaced from terminal 18. When air cylinder 24 is deenergized to allow the return spring to pull piston rod 128 inwardly, the assembly comprising lever 116, cylinder 24, blocks 108, 102 and housing 20 are translated inwardly to the position shown in FIG. 10. In this position, guide 22 is positioned adjacent terminal 18. Upon rotation of guide 22 about terminal 18, the wire held by guide 22 will be wrapped about the terminal.

Cylinder 24 may be a double acting cylinder, or a single acting cylinder which is provided with the return spring described above.

Lever 138 is mounted to a rail 148 which in turn is moveably mounted to the machine frame (not shown). Rail 148 has a dove tail shaped male member 150 thereon which mates with a corresponding female dove shaped recess 152 formed on a block 154. Block 154 is mounted to lever 138 via a conventional screw 156.

Figure 12:
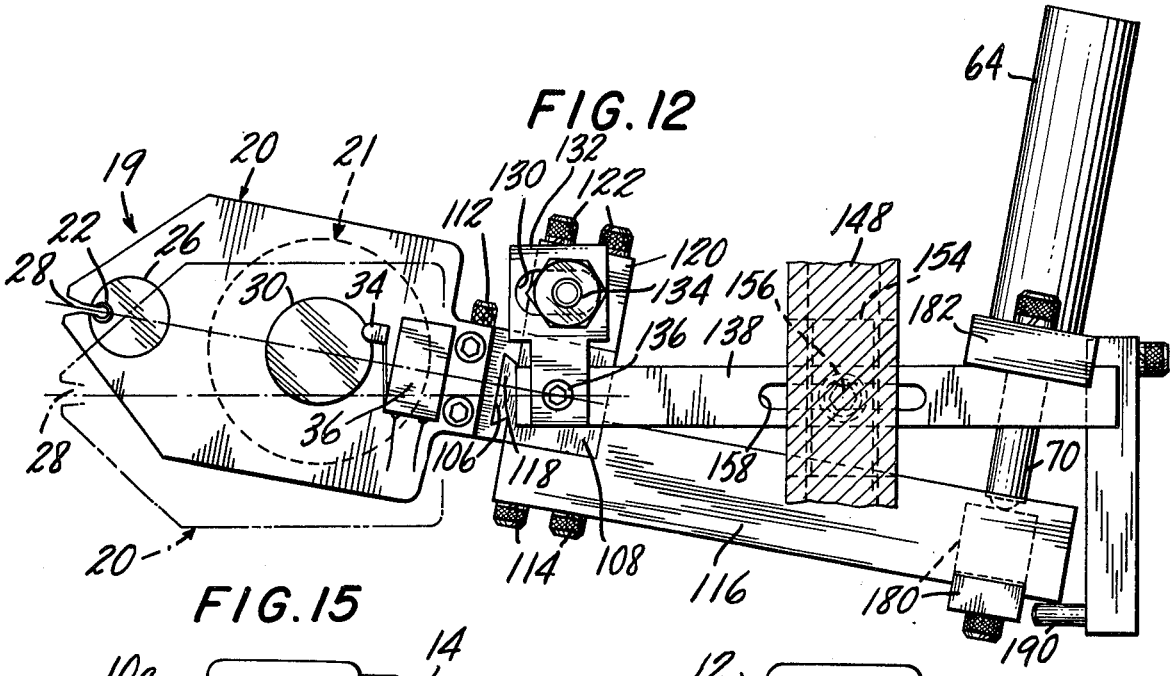
FIG. 12 is a side view of the terminator of FIG. 8 pivoted to its wire breaking position.

Lever 138 is provided with an elongated opening 158 (FIG. 12). The shank of screw 156 fits through this elongated opening but the head of the screw does not. In this manner, block 154, is clamped to shaft 138. Conventional means, such as screws (not shown) are used to secure block 154 and rail 148 together.

Rail 148 is connected to a piston rod 160 (FIG. 8) via a washer 162 and nut 164 positioned on opposite sides of the rail 148 in a manner similar to the connection of piston 128 to block 132. Piston rod 160 is in turn part of an air cylinder 166 which is mounted to a stationary frame indicated by the numeral 168. Upon actuation of the air cylinder 166, piston rod 160 is pulled inwardly, thereby translating rail 148, lever 138, and the entire terminator assembly to the position shown in FIGS. 2 and 11. The position of housing 20 in FIG. 1 indicates the rest position of the apparatus in which the guide 22 is spaced from the terminal 18 of the bobbin. This relationship is most clearly seen in FIG. 20 where the terminator assemblies 170, 172 are not adjacent the terminals 18*d* of bobbin 10*d* shown therein. By spacing the terminator assemblies away from the bobbin until needed, the likelihood of the terminator assembly interfering with the other operations to be performed on the bobbin is eliminated.

The dotted line position of housing 20 shown in FIG. 8 corresponds to the fully translated position in which the guide 22 is positioned as shown in FIG. 11, after which movement to the position shown in FIG. 10 occurs, to wrap wire about the terminal 18.

The instant terminator assembly is adapted for use with different types of bobbins which may have terminals on one side or the other thereof. Bobbin 10*c*(FIG. 19) has two terminals 18*c*, one closer to the terminator assembly than the other. In FIG. 19, both terminator assemblies are at their untranslated position (shown as the full outline position in FIG. 8. Yet, terminator 170 is more toward the bobbin than terminator assembly 172 in order to be able to position guide 22' adjacent rear terminal 18*c*. Since forward translatory motion of the terminator assembly is limited by the stroke of piston rod 160 (FIG. 8), terminator assembly 170 must be repositioned, as shown, by loosening screw 156 which mounts lever 138 to rail 148. Lever 138 is then moved in the selected direction until the terminator assembly 170 has been moved to the desired position, as shown in FIG. 19. Screw 156 is then tightened to fix the new position of the terminator assembly 170 with respect to rail 148. Of course, vertical repositioning of the entire terminator assembly can be accomplished by loosening the fastening means (not shown) which secure block 154 to rail 148 and then moving the terminator assembly upwardly or downwardly as the case may be. The terminator assembly is then fixed in its new position by re-fastening the block 154 to rail 148.

Most bobbins have configurations of the type shown in FIG. 15 where the terminal, here denoted by the numeral 18*a*, is adjacent the point at which the wire exits the bobbin core. The foregoing description concerned use of the terminator for wrappping wire about a terminal which is adjacent to the wire exit point.

However, many bobbins, such as the one shown in FIG. 16 and denoted by the numeral 10*b*, have a terminal 18*b* which is displaced from the wire exit point. When the wire is to be wrapped about the terminal, the pivot center of guide 22 must be in alignment with the terminal.

To accommodate situations in which the wire exits the bobbin at a distance from the terminal, lever 116 is provided with a pitch cam 180 (FIG. 17). A holder 182 is mounted on lever 138 at a slight angle thereto. Fixedly mounted on holder 182 is an air cylinder 64 having a piston rod 70. When working with a bobbin of the type shown in FIG. 15, the pitch cam 180 is replaced by a straight block (not shown) which is even with the lower surface of the pitch cam 180 shown in FIGS. 17, *17a.*

Figure 9:
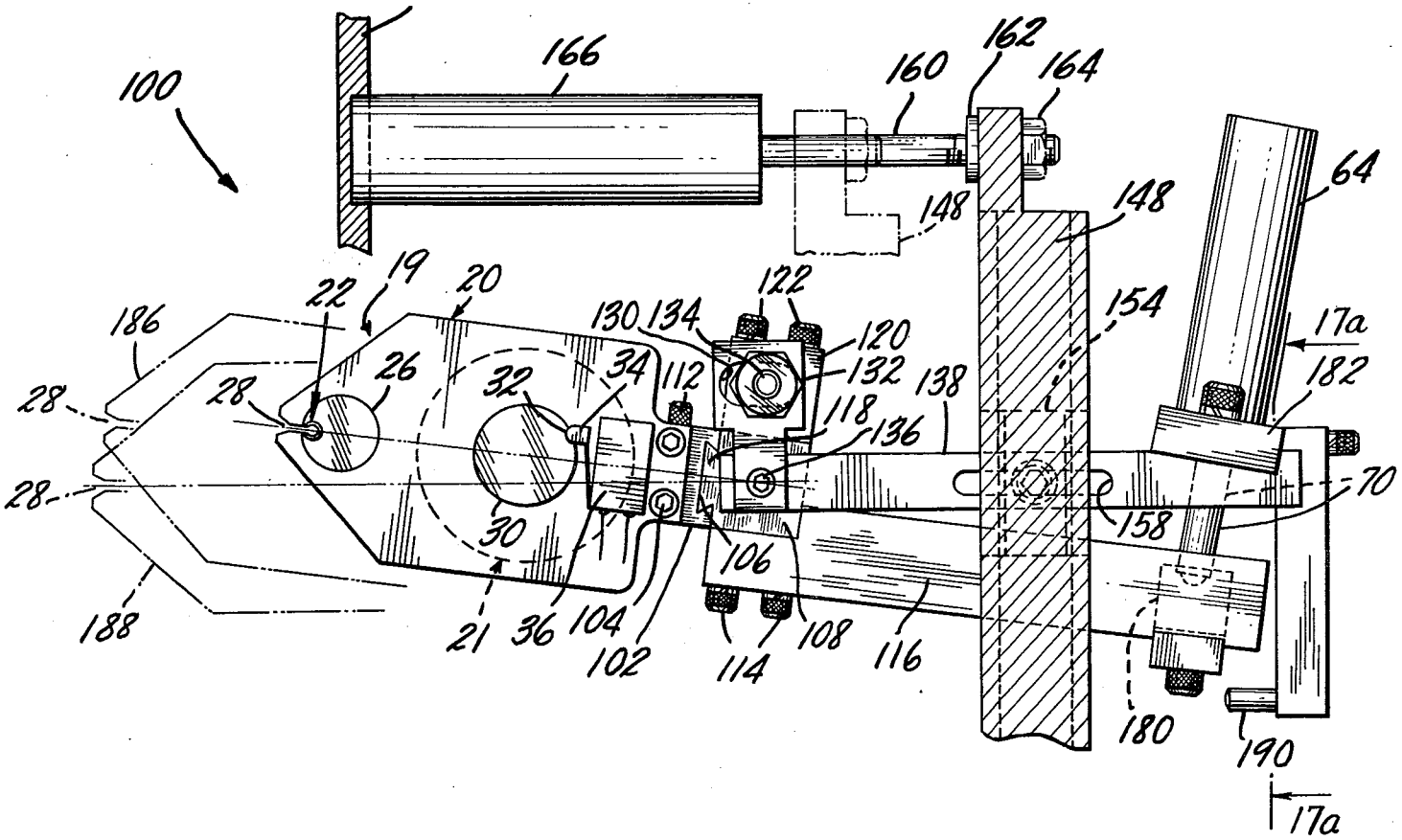
FIG. 9 is a side view of the terminator assembly of FIG. 8 showing the terminator in a pivoted position.

When a bobbin of the type shown in FIG. 16 is used, pitch cam 180 is mounted to lever 116 as shown in FIGS. 9, 17, and *17a.* With the housing 20 in the position shown in FIG. 11 (away from the bobbin) the piston rod 70 will rest on the inclined surface 184 of the pitch cam. In this position, lever 116 will be pushed downwardly and will be pivoted about shaft 144 as most clearly seen in FIG. 9. Housing 20 and guide 22 have now been moved upwardly to a position on a line with the wire exiting from bobbin 10*b* (FIG. 16). Air cylinder 166 is actuated either concurrently with the pivoting motion of lever 116 or afterwards, to translate the terminator assembly forward to the dotted line position shown in FIG. 9 and indicated by the numeral 186. Wire 14 enters opening 28 and is entrained in guide 22. The lever 116 and housing 20 are in the position shown in FIG. 11 and spaced from both the lever 138 and the bobbin.

At this point, cylinder 24 is activated, or deenergized to move the assembly which includes lever 116 and housing 20 towards lever 138 to position wire guide 22 adjacent the terminal. As this movement occurs, piston rod 70 slides downwardly on inclined surface 184 (FIG. *17a*), thereby permitting the lever 116 and housing 20 to return to a substantially horizontal position. The position of the housing 20 at this point in the sequence of operations is indicated by the numeral 188 in FIG. 9. The wire guide 22 is now positioned such that the terminal 18*b*(FIG. 16) is within its circle of rotation, and wrapping of the wire about the terminal may now commence.

Throughout the above described operations, piston rod 70 has remained fixed in relation to the air cylinder 64. After the wire has been wrapped about the terminal of a bobbin, air cylinder 64 is actuated to extend piston rod 70 to the position shown in FIG. 12. The piston rod 70, which is in contact with the pitch cam 180, pivots lever 116 until it contacts stop 190. This pivoting motion is sufficient to break the wire at the terminal, thus completing the sequence of steps for placing the wire on the terminal. To ready itself for the next operation, the terminator housing then moves back to the position shown in FIG. 11, after which air cylinder 166 is energized to move the entire assembly to the full line position shown in FIG. 8.

Often, bobbins will be used in which the wire exits the bobbin at a point lower than the terminal, i.e. opposite to the situation depicted in FIG. 16.

To accommodate such a bobbin, the pitch cam 180 shown in the drawings is replaced by a pitch cam (not shown) having an inclined surface which rises from the lever 116 outwardly, the lowest point of the pitch cam being at the lever 116. In the position of the terminator assembly shown in FIG. 11, the levers 116, 138 will be parallel to pick up the wire. As the levers move together, the lever 116 will be pivoted to raise the housing 20 to a position adjacent the terminal. Many different combinations of wire exit points and terminal locations can be handled singly by adjusting or changing the pitch cam to provide the desired motion of the lever 116.

In FIG. 19, a bobbin 10*c* having two terminals 18*c* is shown. Terminator assembly 170 is shown forward of the position of terminator assembly 172. In this situation, terminator assembly 172 moves forward, and, following the sequence of steps described previously, wraps the wire 14 about the lower terminal 18*c* as viewed in FIG. 19. Next, the automatic winding machine (not shown) rotates shaft 12 180° so that the bobbin terminals will now be adjacent terminator assembly 170. Terminator assembly 170 then moves in to the upper terminal 18*c* as viewed in FIG. 19, following the sequence of steps described above. Terminator 170 clears both terminals 18*c* in its inward translatory motion since the relation of the levers 116, 138 is as shown in FIG. 11. As the distance between levers 116, 138 is decreased to the position shown in FIG. 10 guide 22′ will be in position adjacent the upper terminal 18*c* as viewed in FIG. 19. The lower terminal as viewed in FIG. 19 will not interfere with the housing 20 since it is quite clear from FIG. 10 that the terminals are spaced from the housing during the actual wrapping operation.

FIG. 20 depicts still another type of bobbin 10*d* having opposed terminals 18*d.* In this situation, both terminator assemblies 170 and 172 are positioned abreast of each other. Both may be moved forward simultaneously or one at a time may be activated, as desired.

FIG. 21 shows still another type of bobbin 10*e* in which the terminals 18*e* are one above the other. This bobbin would first have one of the terminals wrapped by a two terminator assembly apparatus as shown in FIG. 20. The bobbin would then be rotated 180° as described in connection with FIG. 19 and the other terminator assembly 170 would then be used to wrap wire around the remaining terminal.

Turning now to FIG. 22 which depicts one embodiment of a pneumatic-electrical system for controlling the sequence of movements of the terminator assembly, the numeral 200 denotes a cam drive motor used to drive a series of cams generally denoted by the numeral 202. The cam drive motor is electrically connected in series to a manual start switch 204. Both the switch 204 and cam drive motor 200 are connected to a source of AC energy, preferably a 60 cycles per second, 115 volt source.

Connected to the output shaft 206 of the cam drive motor 200 are five cams denoted by the numerals 208–216. Switches 218–226 ride atop and are actuatable by cams 208–216 respectively. An air supply line 228 which is connected to a conventional source of pressurized air 230 is in turn connected to airswitches 220,222 and 226 respectively. Airswitches 220 and 222 are tapped into the air supply line 228 in parallel so that each airswitch can receive pressurized air regardless of whether one or the other airswitch is open to receive air.

As shown, a microswitch 218 is connected to the cam drive motor 200 and to one side of the power source. Start switch 204 is connected to one side of the power source and motor 200.

Start switch 204 is held depressed to activate the cam drive motor. The motor drives in the direction of the arrow shown in the drawing. Microswitch cam follower 232 moves out of the depression 234 and closes the contacts of microswitch 218. Motor power is now through microswtich 218, and switch 204 may now be released. As rotation of the cams 202 continues, cam 210, which has raised land 236, will rotate until a switch follower 238 drops down to the reduced diameter section of cam 210. When this occurs, pressurized air will enter the airswitch and be relayed through line 240 to air cylinder 166 to move the entire terminator assembly to the dotted line position shown in FIG. 8 in which the wire is received in guide 22. Air switch 220 as shown is a conventional four way pneumatic airswitch and air cylinder 166 is a conventional double acting penumatic cylinder.

Cam 212, which also rotates, has a raised land area 242 which is contacted by cam follower 244. The peripheral length of the land portion 242 is greater than that of land portion 236 associated with cam 210. Therefore, at some predetermined time after cylinder 166 has been activated, determined by the peripheral extent of land 242, cam follower 244 will drop down to the reduced diameter surface of the cam 212, thereby shutting down the flow of pressurized air to airswitch 222 and through line 246 to air cylinder 24. Airswitch 222 is a conventional three way airswitch. Air cylinder 24 as shown herein is a conventional single acting pneumatic cylinder having a return spring therein (not shown), which normally retains the piston rod 128 of the air cylinder within the air cylinder. Upon shutting the supply of air to cylinder 24, which occurs when cam follower 244 is on the cam surface 242, cylinder 24 is de-energized and moves levers 116 and 138 together.

After the terminator assembly has moved into the full line position shown in FIG. 11, cam follower 244 will drop to the reduced diameter portion 248, thereby cutting off air to the cylinder 24. The return spring then pulls piston rod 128 inwardly and translates the terminator assembly to the position shown in FIG. 10 in which levers 116, 138 are adjacent each other and guide 22 is adjacent the terminal 18 and ready to begin the wrapping cycle.

Microswitch 224 is an electrical switch which is connected to winding motor 21. Winding motor 21 is in turn connected to microswitch 36 and microswitch 36 is in turn connected to a source of electrical power. Microswitch 36 has a cam follower 34 associated therewith which is in contact with a cam 30. Cam 30 is connected to the shaft of motor 21. The winding motor 21, cam follower 34 microswitch 36 and other associated parts are shown here in schematic outline. The relationship of these parts to the entire apparatus is shown and described in detail in connection with the other drawing figures of this application.

In the position shown in FIG. 22, cam follower 34 rests in recess 32 of the cam 30. The microswitch contacts are open and no current flows to the motor 21. When cam 214 rotates to the point where cam follower 250 drops into opening 252, the contacts in microswitch 36 are closed, thereby completing the circuit to the motor 21. Motor 21 then begins to rotate, moving cam follower 34 out of recess 32 so that the cam follower 34 rests on the upper peripheral surface of the cam. In this position of the cam follower 34, microswitch 36 remains closed and the motor 21 continues to be energized. As soon as cam follower 250 lifts out of depression 252, microswitch 224 is opened and the continued rotation of motor 21 is controlled solely by microswitch 36 and cam 30.

Winding motor 21 operates gear 26 to cause guide 22 to rotate and wrap the wire entrained therein about a terminal.

Guide 22 will continue to revolve around the bobbin terminal until cam follower 34 again enters recess 32, thereby opening the microswitch contacts and de-energizing the motor.

After the motor 21 has been de-energized, cam follower 254 of a conventional three way pneumatic air switch 226 reaches groove 256 contained in the surface of cam 216. When this occurs, air cylinder 64 is energized to extend piston rod 70. This pivots the housing 20 upwardly as shown in FIG. 12 and breaks the wire at the terminal. Air cylinder 64 is then de-energized as cam follower 254 reaches the outer peripheral surface 258 of cam 216, thereby allowing housing 20 to return to a horizontal position. Next, air cylinder 24 is energized as the airswitch 222 is closed by cam surface 242 to move the housing 20 from the bobbin, and air cylinder 166 is energized by closing air switch 220 to return the terminator assembly to the position shown in FIG. 1. At this point, cam follower 232 reaches recess 234 on cam 208 and cuts power to cam drive motor 200. The apparatus shown in FIG. 22 is now ready for another complete cycle.

Other types of control systems will be obvious to those of ordinary skill in the art, the above being shown and described as one method for carrying out the program of the terminator assembly.

Many modifications of the above-described embodiments will occur to those skilled in the art. It is intended to cover all such modifications which do not constitute departures from the spirit and scope of the invention as defined in the claims appended hereto.

What is claimed is:

1. An apparatus for wrapping wire on the terminals of a wire carrying bobbin comprising:
   - a bobbin holder,
   - means for engaging the wire comprising a housing, notch means therein for receiving said wire,
   - means for rotating said notch means in said housing and about the terminal such that the wire is wrapped on the terminal, and
   - means for breaking the wire when said rotating means has completed wrapping, and means for breaking the wire comprising means for pivoting said housing away from said bobbin holder.

2. The apparatus according to claim 1 wherein said housing comprises;
   - a forward portion, said portion havng a guide,
   - a rotatable first gear located in said housing, said notch means being formed between two of the teeth, the notch means being in alignment with said guide in the initial position of said first gear,
   - a hollow cylindrical protrusion fixably mounted on the face of said first gear, said protrusion having a lateral groove positioned in alignment with said notch means, and,
   - means for moving said housing to an operating position such that said notch means is offset from the axis of said terminal.

3. The apparatus according to claim 2 wherein the means for rotating comprises;
   - a motor located within said housing and a second gear meshed with said first gear, said second gear located within said housing and attached to said motor.

4. The apparatus according to claim 3 further comprising;
   - a first switch which activates the motor when the wire is engaged,
   - a cam fixably mounted on said second gear, said cam having an indentation thereon,
   - a cam follower in contact with said cam, and, a second switch which deactivates the motor when the cam follower detects one full rotation of said cam.

5. The apparatus according to claim 3 wherein said first and second gears have a gear ratio such that upon one revolution of said second gear said first gear will have revolved more than one time.

6. The apparatus according to claim 1 further comprising a means for guiding the wire into said notch means.

7. A method for wrapping wire on the terminal of a wire carrying bobbin having a length of wire extending therefrom in which a housing containing a wire engaging means rotatable in said housing is used to engage the wire, the method comprising the steps of:

holding the bobbin, engaging the wire extending from the bobbin in said engaging means, rotating the engaging means in said housing to rotate the wire around the terminal such that the wire is wrapped on the terminal, and, pivoting the housing away from the terminal to break the wire at the end of the wrapping operation.

8. A wire wrapping device for wrapping wire about a bobbin terminal comprising: a terminator head, means on said terminator head for engaging said wire, said wire engaging means further comprising means for wrapping said wire about said terminal, first translating means for moving said terminator head between a first position in which the terminator head is laterally spaced from said wire and a second position in which the terminator head engages said wire, second translating means for moving said terminator head longitudinally with respect to said terminal between a position in which said terminator head is longitudinally spaced from said terminal and another position in which said terminator head is adjacent to and alongside said terminal for wrapping the wire about said terminal.

9. The wire wrapping device according to claim 8 further comprising means for breaking the wire at the terminal after wrapping is complete.

10. The wire wrapping device according to claim 8 wherein said first translating means comprises a rail, means mounting said terminator head to said rail, said rail being moveable and means for moving said rail to move said terminator head between said first and second positions.

11. The wire wrapping device according to claim 10 wherein said means for moving said rail comprises a pneumatic cylinder.

12. The wire wrapping device according to claim 8 wherein said second translating means comprises first and second levers, said terminator head being fixedly mounted to said first lever, means for moveably connecting said first and second levers together comprising a second penumatic cylinder having a body and a piston rod, said body being mounted on said first lever and said piston rod being mounted on said second lever, said piston rod being moveable to move said first and second lever relative to each other to move said terminator head between the position in which the terminator head is longitudinally spaced from said terminal and the position in which the terminator head is adjacent said terminal.

13. The wire wrapping device according to claim 12 wherein said first lever is translated longitudinally and said second lever is positionally fixed with respect to movement in the longitudinal direction.

14. The wire wrapping device according to claim 12 further comprising a male block mounted to said terminator head, a female block mounted to said first lever, said male and female blocks forming a coupling for adjustably coupling said terminator head to said first lever, said male and female blocks being adjustable to permit selective positioning of said terminator head on said first lever to vary the two end points of said second translatory movement.

15. The wire wrapping device according to claim 12 wherein said second pneumatic cylinder further comprises a spring therein. for normally biasing said terminator head to a position adjacent said terminal.

16. The wire wrapping device according to claim 12 further comprising an upright mounting block on said second lever, said upright mounting block having an elongated slot therein, and means for mounting said piston rod in said elongated slot for sliding movement in said elongated slot.

17. The wire wrapping device according to claim 12 wherein said second lever is displaced from said first lever, cam means on said first lever having a surface, a third pneumatic cylinder mounted on said second lever and having a third piston rod extending through said second lever and into contact with said surface, said first lever being pivotally mounted on said second shaft at a point displaced from said third pneumatic cylinder.

18. The wire wrapping device according to claim 17 wherein said cam means comprises a pitch cam having a sloping surface on which said third piston rod rests, said first lever being angularly displaced from the horizontal by said cam surface and third piston rod when said terminator head is longitudinally spaced from said terminal and allowed to return to horizontal when said terminator head is moved adjacent to said terminal.

19. The wire wrapping device according to claim 18 further comprising means for actuating said third pneumatic cylinder to extend said third piston rod and angularly pivot said first lever to break said wire at the terminal after the wire has been wrapped about the terminal.

20. The wire wrapping device according to claim 19 further including stop means for limiting the pivoting movement of said first lever during actuation of said third penumatic cylinder.

21. The wire wrapping device according to claim 8 further comprising a motor and a plurality of cams connected in series to said motor for controlling the movements of said terminator head, and a plurality of air switches, each air switch being associated with one said cam, and an air source, said air switches contol the feed of air from said source to said first and second translator means.

22. The wire wrapping device according to claim 21 further comprising and a cam and microswitch for initiating said wrapping.

23. A bobbin terminator assembly of the type used for wrapping wire about a terminal of a bobbin in which the wire exits the bobbin at a point not adjacent the terminal comprising aterminator head having a wire guide for engaging and wrapping said wire about the terminal, said wire guide normally being positioned adjacent said terminal, means for tilting said terminator to bring said wire guide into alignment with said wire, means for engaging said wire, and means for returning said terminator head to said position adjacent said terminal for wrapping the wire about the said terminal.

24. The bobbin terminator assembly according to claim 23 wherein said means for tilting the terminator head comprises a lever on which said terminator head is mounted, said lever being pivotable a selected amount of aligning the terminator head with the wire.

25. The bobbin terminator assembly according to claim 24 fhurther comprising step means for limiting the pivoting motion of said lever.

* * * * *